US006904622B1

(12) United States Patent
Gabriel

(10) Patent No.: US 6,904,622 B1
(45) Date of Patent: Jun. 14, 2005

(54) AUXILIARY TOILET SEAT

(76) Inventor: Andrew E. Gabriel, 3209 Humbolt Ave., Santa Clara, CA (US) 95051

( * ) Notice: Subject to any disclaimer, the term of this patent is extended or adjusted under 35 U.S.C. 154(b) by 0 days.

(21) Appl. No.: 10/972,219

(22) Filed: Oct. 25, 2004

(51) Int. Cl.[7] ..... A47K 13/00
(52) U.S. Cl. ..... 4/237; 4/254
(58) Field of Search ..... 4/237, 239, 240, 4/254, 480, 667

(56) References Cited

U.S. PATENT DOCUMENTS 3,392,411 A * 7/1968 Hansen ..... 4/239
D243,089 S 1/1977 Halvorsen
5,248,105 A 9/1993 Cooker
5,526,537 A 6/1996 Conrad
5,727,843 A 3/1998 LaTrace
6,185,759 B1 2/2001 Staudenmayer
6,324,705 B1 12/2001 Zephier

* cited by examiner

*Primary Examiner*—Tuan Nguyen

(57) ABSTRACT

An auxiliary toilet seat includes a seat portion that is positionable on top of a toilet stool rim. Such a seat portion has an integrally disposed flange extending rearwardly from the opening. The apparatus includes a back portion pivotally connected to the flange that has a front surface including a plurality of resilient support members extending forwardly therefrom and a horizontally disposed support plate extending rearwardly therefrom. A rigid fastening member including opposed end portions is positioned through the support plate for effectively securing the toilet seat to the toilet stool. A plurality of arm rests are connected to the back portion wherein such arm rests are movable along a plurality of arcuate paths and a linear path. The arm rests include a plurality of elongated support portions and a plurality of couplings operably connected to the support portions.

18 Claims, 7 Drawing Sheets

AUXILIARY TOILET SEAT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a toilet seat and, more particularly, to an auxiliary toilet seat for providing user comfort during operating conditions.

2. Prior Art

In caring at home for persons who cannot care for themselves, it is often inconvenient for them to use a bathroom that does not meet their needs. Conventional toilets are unsuitable for such patients and even perhaps for persons with slight handicaps. It is true that these toilets can be adapted or reconstructed to suit the needs of these persons, but this is very expensive and sometimes, as in rented apartments, is not allowed. With increasing age or with handicaps from illness come physical limitations that make it impossible for a person to use conventional toilets without help from others.

As nursing home accommodations for such patients become increasingly expensive, it is becoming more and more common for them to be cared for at home. Daily care for such a patient demands enormous effort on the part of the caregiver since, as a rule, the patient must be transported onto the toilet, and afterward, back into bed. In general, wheelchairs cannot be used in conventional bathrooms.

The use of commode chairs is known in the prior art. The primary users of such commode chairs often have some type of physical disability that impairs the freedom of movement of the user. Because of their disabilities, commode chair users can find it difficult, if not impossible, to sense and react to the occurrence of points of excessive and prolonged pressure on the user's body. For example, two points where pressure may concentrate on the buttocks of the user are the areas of flesh surrounding the trochanter and ishial areas of the skeleton. The exposure to the pressure for a prolonged period can lead to a break down of the user's skin, and may produce open sores that can become infected and even lead to amputations of the legs of the user.

Commode chairs heretofore known have included various structures for reducing the supportive pressure exerted on the buttocks of the user. Commode chairs having cushions with enhanced padding, and even inflatable cushions, have been devised for reducing the likelihood of problems caused by excess concentrations of pressure on the skin of the user. One concern with cushions that exert less pressure on vulnerable points of the user's body is that these softer cushions tend to provide less firmness for the user, and thus, the user tends to feel less stable in the chair.

The reduced stability can be of a significant concern to users who do not have full control of their bodies, since these users are less able to react to situations such as, for example, leaning too far in a lateral direction with respect to the commode, or even in a rearward direction toward the rear of the commode. The lessened stability problem appears to be the greatest for the inflatable cushions, since the air within the cushion tends to not provide any significant resistance to these lateral or rearward movements. The air cushions may be provide even less stability when the interior air pressure of the cushion is reduced in order to provide a softer cushion, as compared to higher interior air pressure cushions.

Accordingly, a need remains for an auxiliary toilet seat in order to overcome the above noted shortcomings. The present invention satisfies such a need by providing a toilet seat that is easily accessible and provides superior support and comfort when compared to conventional toilet seats. Such a toilet seat features a larger diameter and armrests that provide stability, especially to handicapped or injured individuals. The auxiliary toilet seat can easily be added to a conventional toilet bowl. Such a toilet seat is appreciated by individuals caring for an injured or handicapped loved-one at home, as well as by nursing homes, hospitals and public restrooms that wish to provide improved comfort.

BRIEF SUMMARY OF THE INVENTION

In view of the foregoing background, it is therefore an object of the present invention to provide an apparatus for an auxiliary toilet seat. These and other objects, features, and advantages of the invention are provided by a toilet seat removably attachable to an existing toilet stool for providing user comfort during operating conditions.

The toilet seat includes a seat portion that has a generally annular shape and is conveniently positionable on top of a toilet stool rim such that the seat portion defines a centrally disposed opening therethrough. Such a seat portion has an integrally disposed flange extending rearwardly from the opening.

A back portion is pivotally connected to the flange such that the seat portion can be adapted between raised and lowered positions while the back portion remains at a substantially upright position. Such a back portion extends rearwardly and upwardly from the seat portion and has a top end terminating at a predetermined height thereabove.

The back portion further has a front surface including a plurality of resilient support members extending forwardly therefrom for advantageously providing lumbar support to a user seated on the seat portion. The front surface of the back portion is preferably formed to be substantially concave and includes outer edge portions converging downwardly towards the seat portion. Such a back portion includes a horizontally disposed support plate extending rearwardly therefrom and is positioned adjacent a selected portion of the toilet stool. A rigid fastening member having a substantially U-shape and including opposed end portions is positioned through the support plate for effectively securing the toilet seat to the toilet stool.

A plurality of arm rests are connected to the back portion and extend forwardly therefrom. The arm rests preferably include a plurality of brackets secured to the back portion wherein the brackets are provided with a plurality of elongated slots through which the arm rests can be slidably positioned. Such arm rests are contemporaneously movable along a plurality of arcuate paths and a linear path respectively such that a user can conveniently adapt the arm rests to a desired position. Such a plurality of arcuate paths are defined along a substantially vertical axis and a substantially horizontal axis and the linear path is defined along a substantially vertical axis.

The arm rests include a plurality of elongated support portions symmetrically positionable on opposed sides of the seat portion and a plurality of couplings operably connected to the support portions for assisting a user to rotate the arm rests along one of the arcuate paths respectively.

The toilet seat may further include a head rest removably attachable to the back portion. Such a head rest advantageously includes a padded front surface for providing support. Such a toilet seat may also further include an ashtray connected to one of the arm rests. The ash tray has a substantially linear edge portion defining a fulcrum axis about which the ashtray can be pivoted between folded and exposed positions. Such an ashtray is provided with an opening therein for conveniently receiving and maintaining a beverage bottle at a fixed position.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
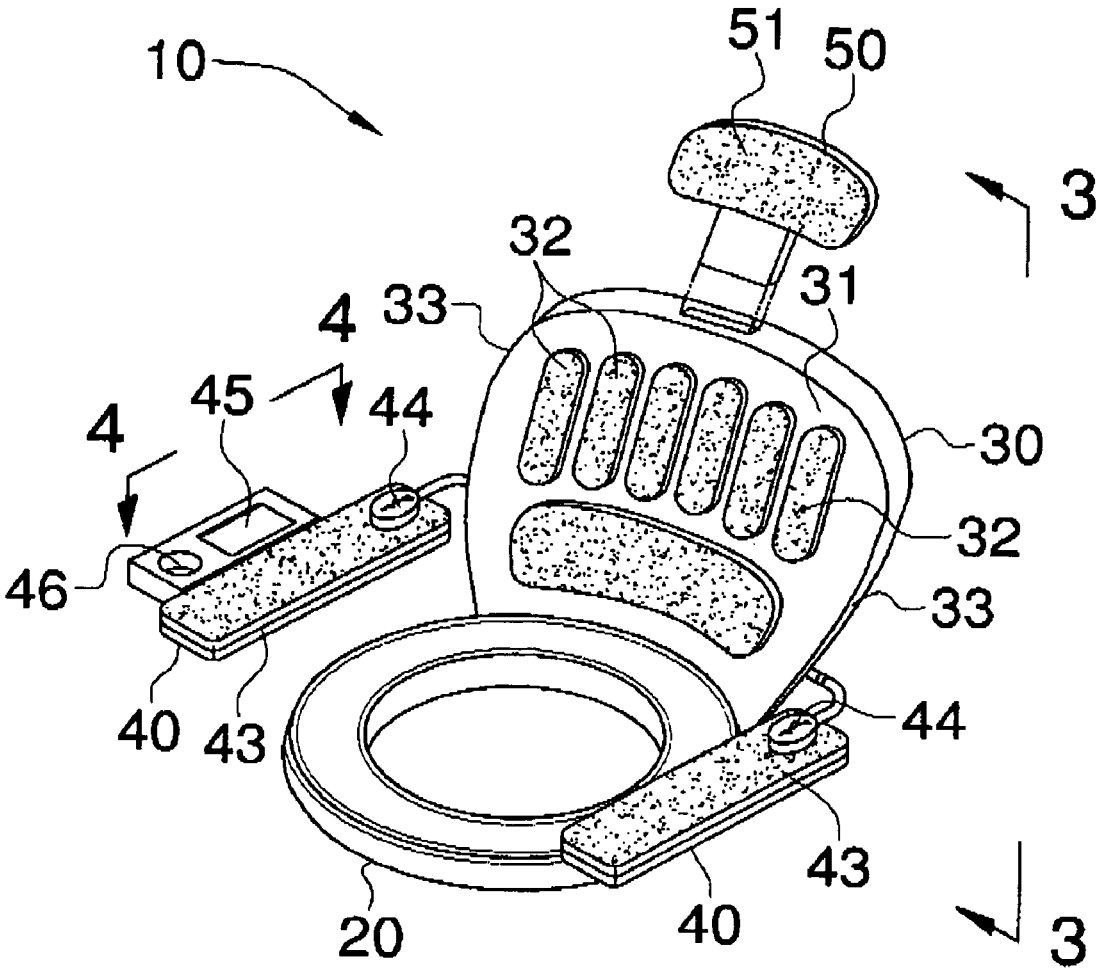
FIG. 1 is a perspective view showing an auxiliary toilet seat, in accordance with the present invention.
Figure 2:
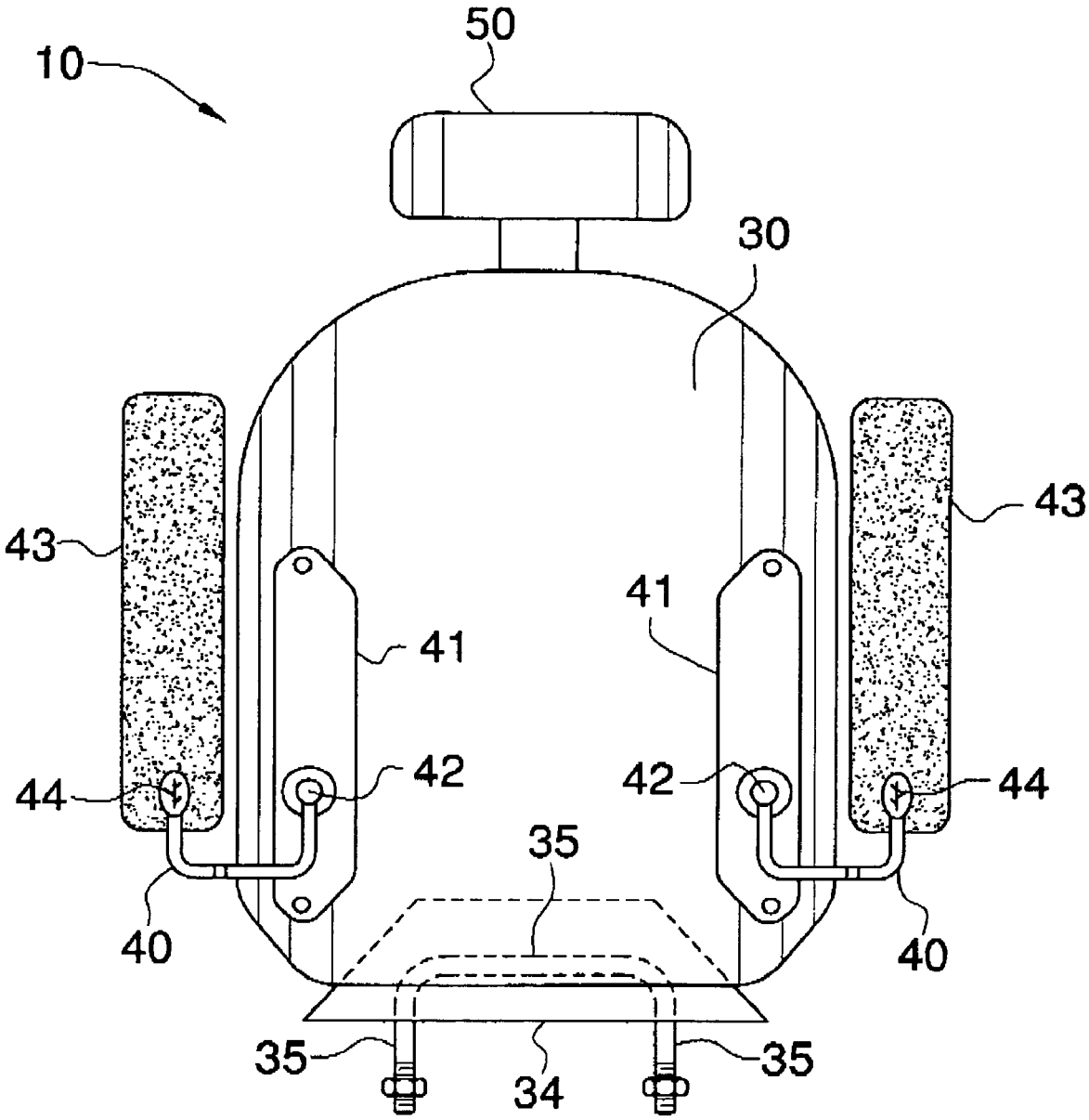
FIG. 2 is a rear elevational view of the apparatus shown in FIG. 1.
Figure 3:
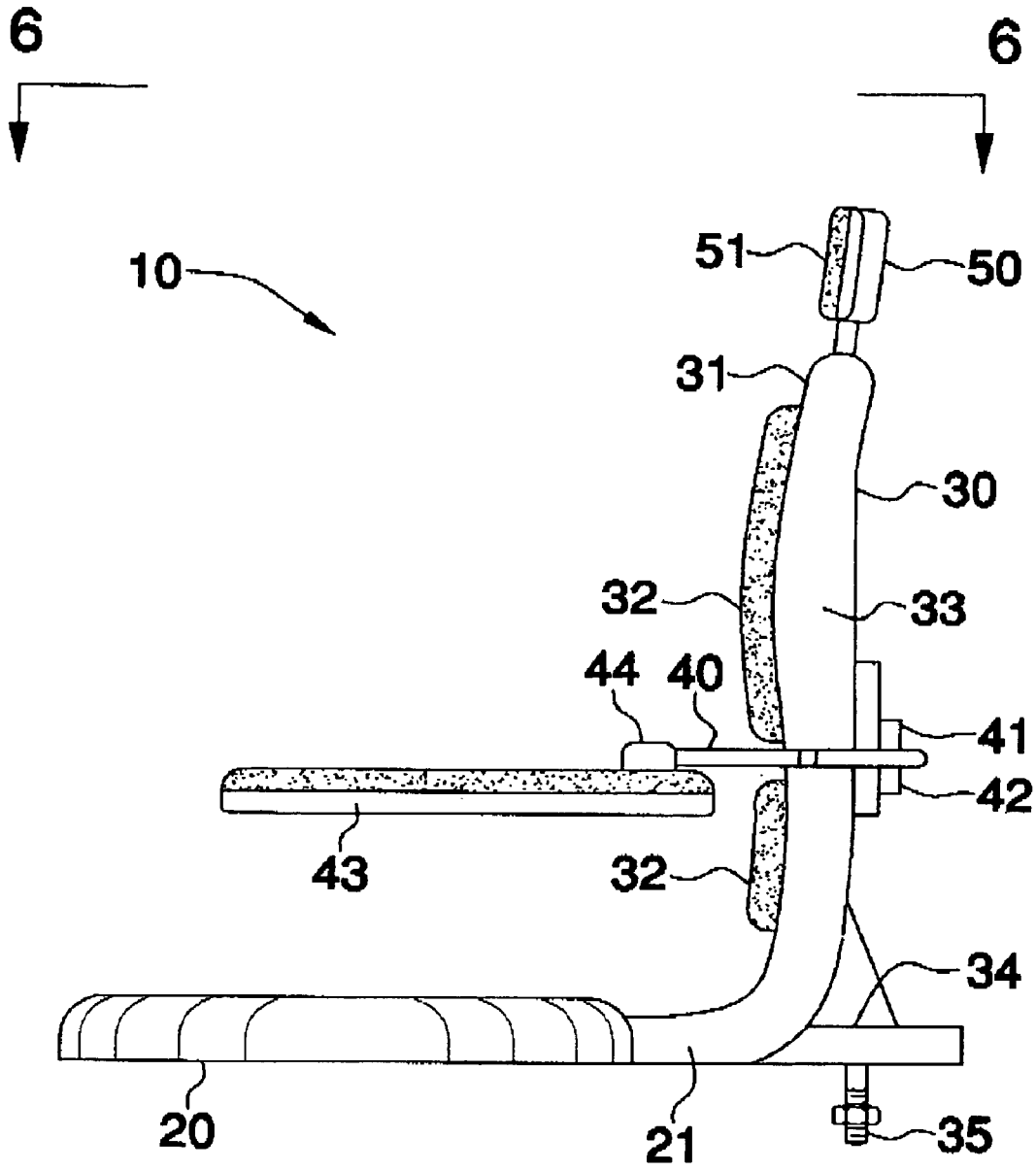
FIG. 3 is an enlarged side elevational view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–7 by the reference numeral 10 and is intended to provide an auxiliary toilet seat. It should be understood that the apparatus 10 may be used to provide comfort to many different individuals and should not be limited to only the injured or handicapped.

Figure 7:
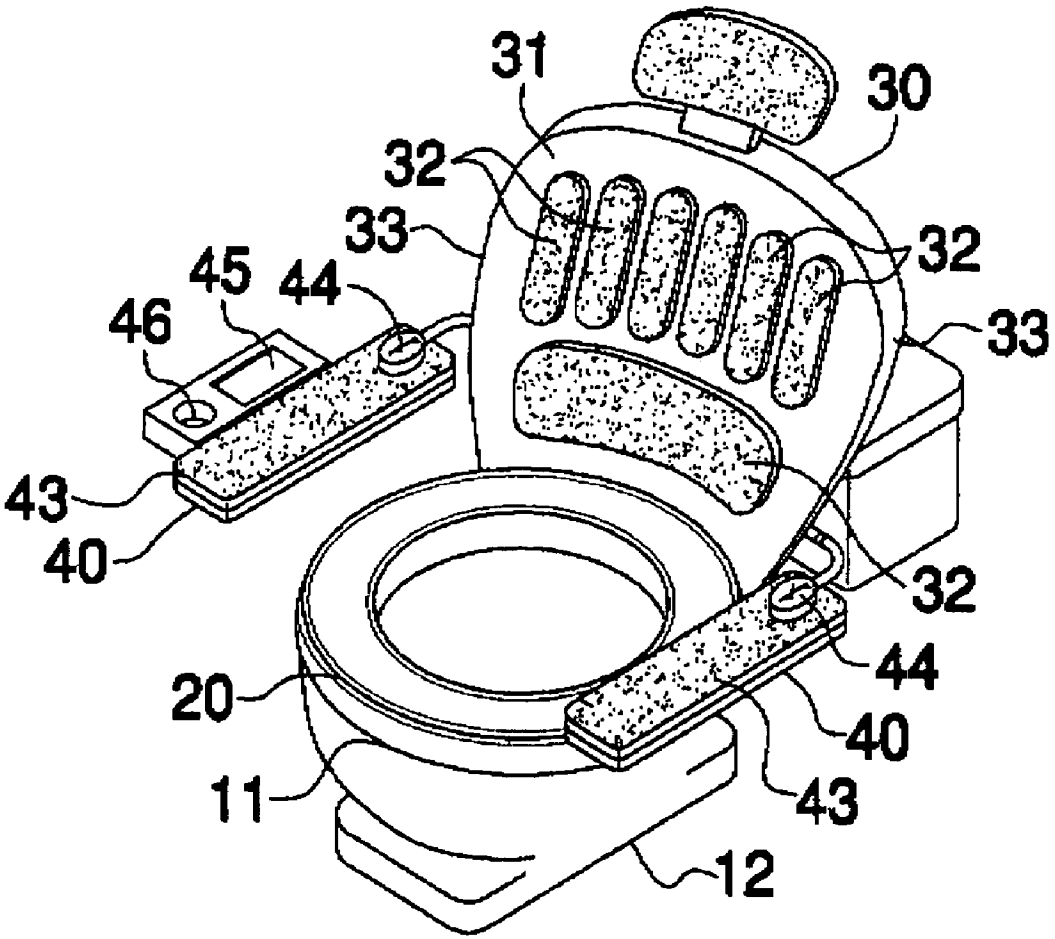
FIG. 7 is a perspective view showing the apparatus shown in FIG. 1 positioned on top of a toilet stool rim.

Referring initially to FIGS. 1 and 7, the apparatus 10 includes a seat portion 20 that has a generally annular shape and is conveniently positionable on top of a toilet stool rim 11 such that the seat portion 20 defines a centrally disposed opening therethrough. Such a seat portion 20 has an integrally disposed flange 21 extending rearwardly from the opening.

Referring to FIGS. 1, 2, 3, 6 and 7, a back portion 30 is pivotally connected to the flange 21 such that the seat portion 20 can be adapted between raised and lowered positions while the back portion 30 remains at a substantially upright position, thus conveniently preventing the seat portion 20 from being urinated upon in the event that an individual is standing in front of it during operating conditions. Such a back portion 30 extends rearwardly and upwardly from the seat portion 20 and has a top end terminating at a predetermined height thereabove.

Referring to FIGS. 1, 3, 6 and 7, the back portion 30 further has a front surface 31 including a plurality of resilient support members 32 extending forwardly therefrom for advantageously providing lumbar support to a user seated on the seat portion. The front surface 31 of the back portion 30 is formed to be substantially concave and includes outer edge portions 33 converging downwardly towards the seat portion 20, thus securing and conforming to an individual's back and advantageously maintaining them upright. Such a back portion 30 includes a horizontally disposed support plate 34 extending rearwardly therefrom and is positioned adjacent a selected portion of the toilet stool 12. A rigid fastening member 35 having a substantially U-shape and including opposed end portions is positioned through the support plate 34 for effectively securing the toilet seat 10 to the toilet stool 12.

Figure 4:
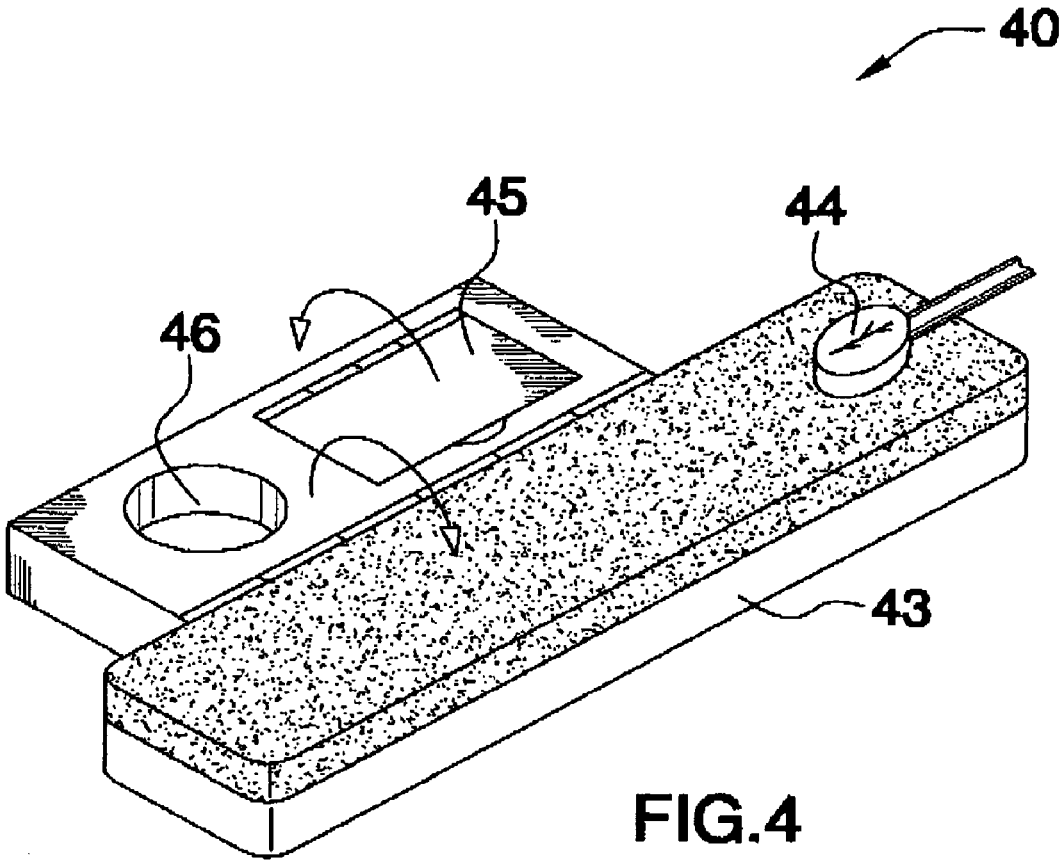
FIG. 4 is an enlarged perspective view of the arm rest shown in FIG. 1, showing the ashtray and the beverage container opening.
Figure 5:
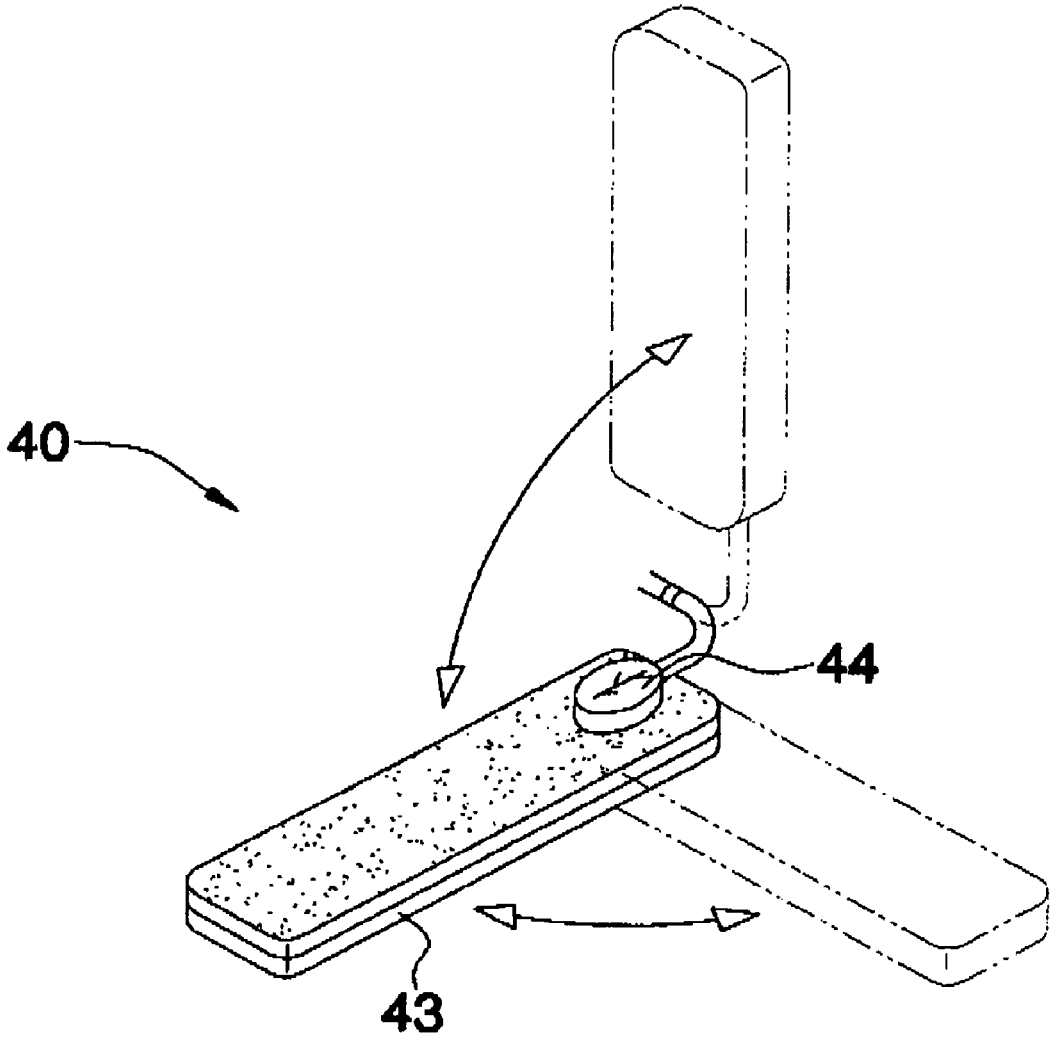
FIG. 5 is a perspective view of the armrest shown in FIG. 4, showing the arcuate paths along which it may move.
Figure 6:
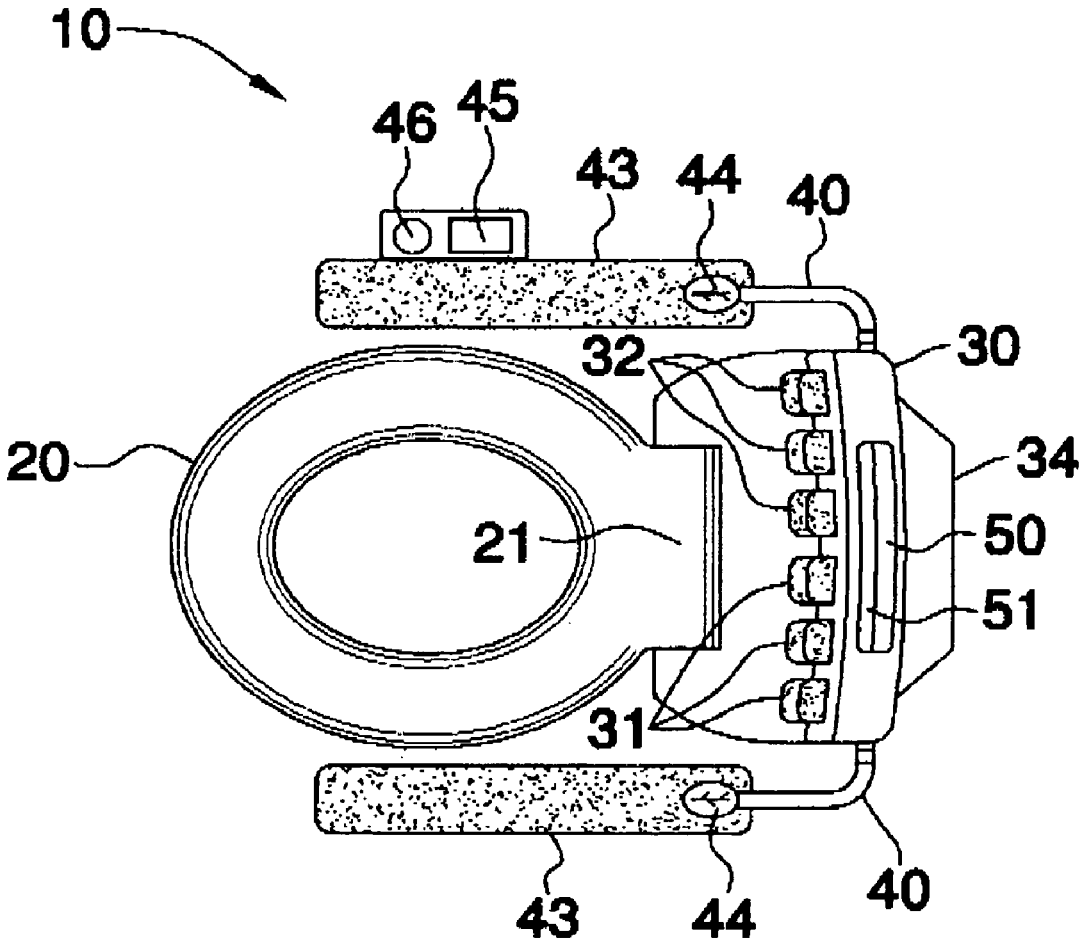
FIG. 6 is a top-plan view of the apparatus shown in FIG. 3.

Referring to FIGS. 1, 2, 4 and 5, a plurality of arm rests 40 are connected to the back portion 30 and extend forwardly therefrom. The arm rests 40 include a plurality of brackets 41 secured to the back portion 30 wherein the brackets 41 are provided with a plurality of elongated slots 42 through which the arm rests 40 can be slidably positioned. Such arm rests 40 are contemporaneously movable along a plurality of arcuate paths and a linear path respectively such that a user can conveniently adapt the arm rests 40 to a desired position. This feature allows a user to more easily access the seat portion 20 while allowing for optimum comfort once seated. Such a plurality of arcuate paths are defined along a substantially vertical axis and a substantially horizontal axis and the linear path is defined along a substantially vertical axis, as best shown in FIG. 5.

Still referring to FIGS. 1, 2, 4 and 5, the arm rests 40 include a plurality of elongated support portions 43 symmetrically positionable on opposed sides of the seat portion 20 and a plurality of couplings 44 operably connected to the support portions 43 for assisting a user to rotate the arm rests 40 along one of the arcuate paths respectively.

Referring to FIGS. 1, 2, 3, 6 and 7, the toilet seat 10 further includes a head rest 50 removably attachable to the back portion 30. Such a head rest 50 advantageously includes a padded front surface 51 for providing support. Such a toilet seat 10 also further includes an ashtray 45 connected to one of the arm rests 40. The ash tray 45 has a substantially linear edge portion defining a fulcrum axis about which the ashtray 45 can be pivoted between folded and exposed positions, as best shown in FIG. 4. Such an ashtray 45 is provided with an opening 46 therein for conveniently receiving and maintaining a beverage bottle at a fixed position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A toilet seat removably attachable to an existing toilet stool for providing user comfort during operating conditions, said toilet seat comprising:

a seat portion having a generally annular shape and being positionable on top of a toilet stool rim such that said seat portion defines a centrally disposed opening therethrough, said seat portion having an integrally disposed flange extending rearwardly from the opening;

a back portion pivotally connected to said flange such that said seat portion can be adapted between raised and lowered positions while said back portion remains at a substantially upright position, said back portion extending rearwardly and upwardly from said seat portion and having a top end terminating at a predetermined height thereabove, said back portion further having a front surface comprising a plurality of resilient support members extending forwardly therefrom for providing lumbar support to a user seated on said seat portion, said back portion comprising a horizontally disposed support plate extending rearwardly therefrom and being positioned adjacent a selected portion of the toilet stool;

a rigid fastening member having a substantially U-shape and including opposed end portions positioned through said support plate for securing said toilet seat to the toilet stool; and a plurality of arm rests connected to said back portion and extending forwardly therefrom, said arm rests being contemporaneously movable along a plurality of arcuate paths and a linear path respectively such that a user can adapt said arm rests to a desired position.

2. The toilet seat of claim 1, wherein said plurality of arcuate paths are defined along a substantially vertical axis and a substantially horizontal axis.

3. The toilet seat of claim 1, wherein said linear path is defined along a substantially vertical axis, said arm rests comprising a plurality of brackets secured to said back portion wherein said brackets are provided with a plurality of elongated slots through which said arm rests can be slidably positioned.

4. The toilet seat of claim 1, further comprising: a head rest removably attachable to said back portion, said head rest including a padded front surface for providing support.

5. The toilet seat of claim 1, further comprising: an ashtray connected to one said arm rests, said ash tray having a substantially linear edge portion defining a fulcrum axis about which said ashtray can be pivoted between folded and exposed positions, said ashtray being provided with an opening therein for receiving and maintaining a beverage bottle at a fixed position.

6. The toilet seat of claim 1, wherein said front surface of said back portion is formed to be substantially concave and includes outer edge portions converging downwardly towards said seat portion.

7. A toilet seat removably attachable to an existing toilet stool for providing user comfort during operating conditions, said toilet seat comprising:

a seat portion having a generally annular shape and being positionable on top of a toilet stool rim such that said seat portion defines a centrally disposed opening therethrough, said seat portion having an integrally disposed flange extending rearwardly from the opening;

a back portion pivotally connected to said flange such that said seat portion can be adapted between raised and lowered positions while said back portion remains at a substantially upright position, said back portion extending rearwardly and upwardly from said seat portion and having a top end terminating at a predetermined height thereabove, said back portion further having a front surface comprising a plurality of resilient support members extending forwardly therefrom for providing lumbar support to a user seated on said seat portion, said back portion comprising a horizontally disposed support plate extending rearwardly therefrom and being positioned adjacent a selected portion of the toilet stool;

a rigid fastening member having a substantially U-shape and including opposed end portions positioned through said support plate for securing said toilet seat to the toilet stool; and a plurality of arm rests connected to said back portion and extending forwardly therefrom, said arm rests being contemporaneously movable along a plurality of arcuate paths and a linear path respectively such that a user can adapt said arm rests to a desired position, said arm rests comprising a plurality of elongated support portions symmetrically positionable on opposed sides of said seat portion.

8. The toilet seat of claim 7, wherein said plurality of arcuate paths are defined along a substantially vertical axis and a substantially horizontal axis.

9. The toilet seat of claim 7, wherein said linear path is defined along a substantially vertical axis, said arm rests comprising a plurality of brackets secured to said back portion wherein said brackets are provided with a plurality of elongated slots through which said arm rests can be slidably positioned.

10. The toilet seat of claim 7, further comprising: a head rest removably attachable to said back portion, said head rest including a padded front surface for providing support.

11. The toilet seat of claim 7, further comprising: an ashtray connected to one said arm rests, said ash tray having a substantially linear edge portion defining a fulcrum axis about which said ashtray can be pivoted between folded and exposed positions, said ashtray being provided with an opening therein for receiving and maintaining a beverage bottle at a fixed position.

12. The toilet seat of claim 7, wherein said front surface of said back portion is formed to be substantially concave and includes outer edge portions converging downwardly towards said seat portion.

13. A toilet seat removably attachable to an existing toilet stool for providing user comfort during operating conditions, said toilet seat comprising:

a seat portion having a generally annular shape and being positionable on top of a toilet stool rim such that said seat portion defines a centrally disposed opening therethrough, said seat portion having an integrally disposed flange extending rearwardly from the opening;

a back portion pivotally connected to said flange such that said seat portion can be adapted between raised and lowered positions while said back portion remains at a substantially upright position, said back portion extending rearwardly and upwardly from said seat portion and having a top end terminating at a predetermined height thereabove, said back portion further having a front surface comprising a plurality of resilient support members extending forwardly therefrom for providing lumbar support to a user seated on said seat portion, said back portion comprising a horizontally disposed support plate extending rearwardly therefrom and being positioned adjacent a selected portion of the toilet stool;

a rigid fastening member having a substantially U-shape and including opposed end portions positioned through said support plate for securing said toilet seat to the toilet stool; and a plurality of arm rests connected to said back portion and extending forwardly therefrom, said arm rests being contemporaneously movable along a plurality of arcuate paths and a linear path respectively such that a user can adapt said arm rests to a desired position, said arm rests comprising a plurality of elongated support portions symmetrically positionable on opposed sides of said seat portion, and a plurality of couplings operably connected to said support portions for assisting a user to rotate said arm rests along one said arcuate paths respectively.

14. The toilet seat of claim 13, wherein said plurality of arcuate paths are defined along a substantially vertical axis and a substantially horizontal axis.

15. The toilet seat of claim 13, wherein said linear path is defined along a substantially vertical axis, said arm rests comprising a plurality of brackets secured to said back portion wherein said brackets are provided with a plurality of elongated slots through which said arm rests can be slidably positioned.

16. The toilet seat of claim 13, further comprising: a head rest removably attachable to said back portion, said head rest including a padded front surface for providing support.

17. The toilet seat of claim 13, further comprising: an ashtray connected to one said arm rests, said ash tray having a substantially linear edge portion defining a fulcrum axis about which said ashtray can be pivoted between folded and exposed positions, said ashtray being provided with an opening therein for receiving and maintaining a beverage bottle at a fixed position.

18. The toilet seat of claim 13, wherein said front surface of said back portion is formed to be substantially concave and includes outer edge portions converging downwardly towards said seat portion.

* * * * *